United States Patent [19]

Chodorow et al.

[11] 4,398,121

[45] Aug. 9, 1983

[54] MODE SUPPRESSION MEANS FOR GYROTRON CAVITIES

[75] Inventors: Marvin Chodorow, Stanford; Robert S. Symons, Los Altos, both of Calif.

[73] Assignee: Varian Associates, Inc., Palo Alto, Calif.

[21] Appl. No.: 232,059

[22] Filed: Feb. 5, 1981

[51] Int. Cl.[3] ..... H01J 25/00

[52] U.S. Cl. ..... 315/4; 315/3; 315/5; 333/228

[58] Field of Search ..... 315/3, 4, 5, 5.31, 5.38, 315/5.35; 333/228, 229

[56] References Cited

U.S. PATENT DOCUMENTS 3,259,786 7/1966 Phillips ..... 315/3
3,369,197 2/1968 Giger et al. ..... 333/228 X
3,634,790 1/1972 Turteltaub ..... 333/228
4,282,458 8/1981 Barnett ..... 315/5

FOREIGN PATENT DOCUMENTS 55-113240 1/1980 Japan ..... 315/4

*Primary Examiner*—Saxfield Chatmon, Jr.
*Attorney, Agent, or Firm*—Stanley Z. Cole; Richard B. Nelson

[57] ABSTRACT

In a gyrotron electron tube of the gyro-klystron or gyro-monotron type, having a cavity supporting an electromagnetic mode with circular electric field, spurious resonances can occur in modes having noncircular electric field. These spurious resonances are damped and their frequencies shifted by a circular groove in the cavity parallel to the electric field.

4 Claims, 5 Drawing Figures

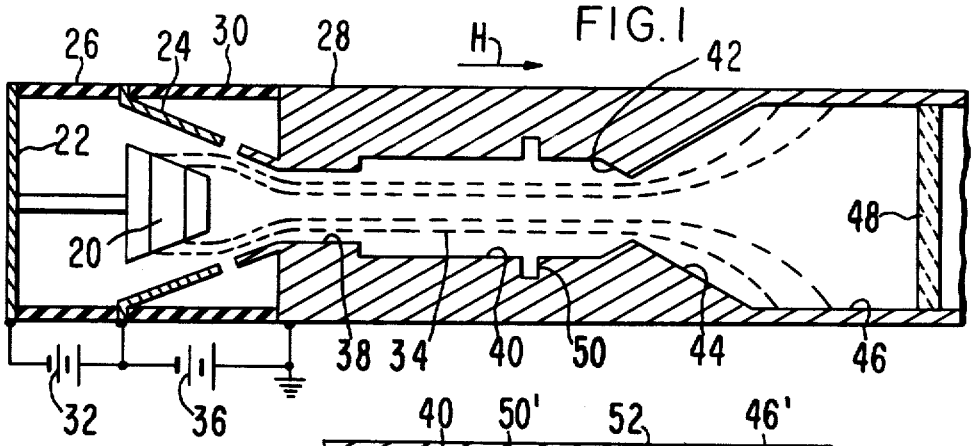
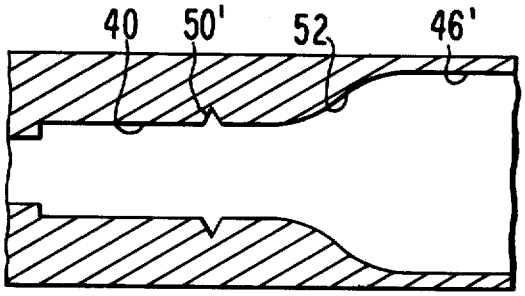
FIG.2
FIG.3
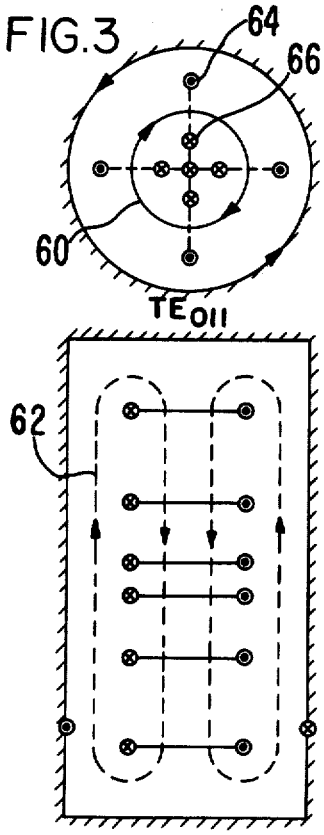
FIG.4
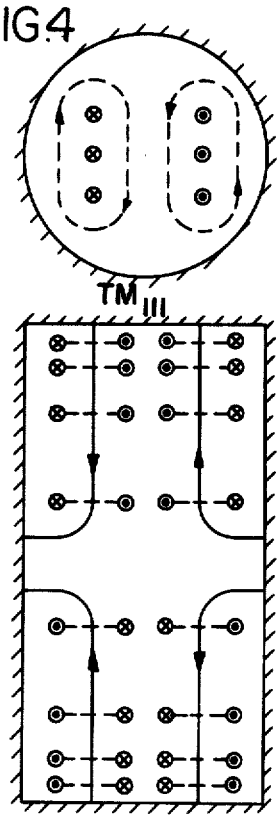
FIG.5
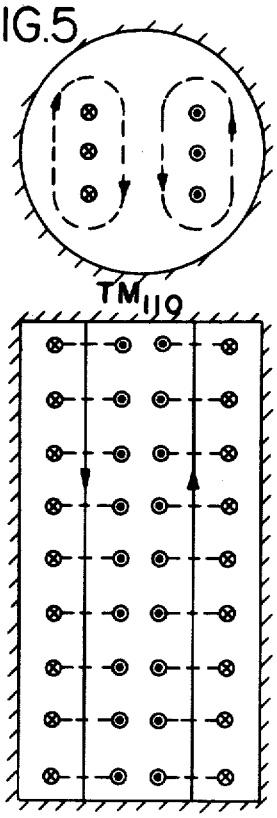

MODE SUPPRESSION MEANS FOR GYROTRON CAVITIES

The Government has rights in this invention persuant to Contract No. 53X-01617C awarded by the U.S. Department of Energy.

DESCRIPTION

1. Field of the Invention

The invention pertains to microwave vacuum tubes using a cyclotron-resonance-maser type interaction between a beam of spiraling charged particles such as electrons and an electromagnetic wave. In the so-called gyro-klystron or gyro-monotron (gyrotron) the wave is a standing wave in a hollow resonant cavity. The spiral motion of the electrons is produced by a magnetic field directed along the axis of propagation of the beam, whereby individual particles traverse spiral orbits at their cyclotron frequency. The cavity typically resonates in a mode having circular electric field perpendicular to the axis. Cavity resonances of lower order or noncircular electric fields may be excited by coupling from the desired mode, as caused by small asymmetries in the geometry, or by direct interaction with the beam.

2. Prior Art

The circular-electric-field modes of waveguides and resonant cavities have been extensively studied. The impetus to use these modes is basically their very low loss characteristics. They are higher-order modes; that is, at their lower cut-off frequency in a waveguide other lower-order modes can propagate. There is, thus, always a problem of conversion of the energy to lower-order modes. In the prior art use has been made of the axial symmetry of the circular-electric-field modes to couple out the energy of any non-circular-field mode and absorb it in a lossy resistive load. In the circular-electric-field mode in a cylindrical waveguide or cavity, the electric currents in the walls flow in circles about the axis. Therefore, one can cut circular grooves or the like in the wall without interrupting the currents of the circular-electric-field mode. Other, interfering modes, however, have axial components of wall current. These must cross the grooves, exciting fields in them which are absorbed by lossy material recessed in the grooves. U.S. Pat. No. 3,471,744, issued Oct. 7, 1969 to G. G. Pryor, describes slot-type mode absorbers in a magnetron resonant cavity. U.S. Pat. No. 3,441,793, issued Apr. 29, 1969 to Poda Fosse and G. E. Glenfield, describes circular slots in a waveguide for coupling non-circular modes to an absorber outside the guide. U.S. Pat. No. 3,008,102, issued Nov. 11, 1961 to Maurice W. St. Clair, describes a circular-electric-field stabilizing cavity in which the cylindrical wall is made of circular conductors interspersed with lossy material. The above-cited patents are assigned to the assignee of the present application. They all involve absorbing, within the cavity, the energy of non-circular modes. The gyrotron of the present invention generates much higher microwave power than any prior-art source, such as 100 kilowatts at 100 gigahertz. Thus, any absorbing material in the cavity, even if selectively coupled to non-circular modes, would quickly burn up.

SUMMARY OF THE INVENTION

The object of the invention is to provide a gyrotron in which certain non-circular modes are suppressed by coupling their energy into the output waveguide.

This object is achieved by incorporating a circular groove in the conducting outer wall of the resonant cavity. The groove presents a reactive load to many non-circular modes, perturbing their field patterns in a way which enhances their coupling to the waveguide.

BRIEF DESCRIPTION OF THE DRAWINGS

FIG. 1 is a schematic axial section of a gyro-monotron embodying the invention.

FIG. 2 is a schematic section of a portion of a different gyro-monotron embodying the invention.

FIG. 3 is a sketch of the field pattern of the $TE_{011}$ mode in a cylindrical resonator.

FIG. 4 is a sketch of the $TM_{111}$ mode in a cylindrical resonator.

FIG. 5 is a sketch of the $TM_{110}$ mode.

FIG. 1 is a sketch of a gyro-monotron embodying the invention. The gyrotron is a microwave tube in which a beam of electrons having a spiral motion in an axial magnetic field parallel to their drift direction interacts with the electric fields of a wave-supporting circuit. The electric field in practical tubes is in a circular-electric-field mode. In the gyro-klystron or gyro-monotron, the wave-supporting circuit is a resonant cavity, usually resonating in a $TE_{0m1}$ mode.

In the gyro-monotron of FIG. 1 a thermionic cathode 20 is supported on the end plate 22 of the vacuum envelope. End plate 22 is sealed to the accelerating anode 24 by a dielectric envelope member 26. Anode 24 in turn is sealed to the main tube body 28 by a second dielectric member 30. In operation, cathode 20 is held at a potential negative to anode 24 by a power supply 32. Cathode 20 is heated by a radiant internal heater (not shown). Thermionic electrons are drawn from its conical outer emitting surface by the attractive field of the coaxial conical anode 24. The entire structure is immersed in an axial magnetic field H produced by a surrounding solenoid magnet (not shown). The initial radial motion of the electrons is converted by the crossed electric and magnetic fields to a motion away from cathode 20. Each electron rotates in a small orbit around a magnetic field line, combined with a slower rotation about the axis and the axial drift velocity. The resulting beam 34 has a hollow envelope. Anode 24 is held at a potential negative to tube body 28 by a second power supply 36, giving further axial acceleration to the beam 34. In the region between cathode 20 and body 28, the strength of magnetic field H is increased greatly, causing beam 34 to be compressed in diameter and also increasing its rotational energy at the expense of axial energy. The rotational energy is the part involved in the useful interaction with the circuit wave fields. The axial energy merely provides beam transport through the interacting region.

Beam 34 passes through a drift-tube 38 into the interaction cavity 40 which is resonant at the operating frequency in a $TE_{0m1}$ mode. The magnetic field strength H is adjusted so that the cylotronfrequency rotary motion of the electrons is approximately synchronous with the cavity resonance. The electrons can then deliver rotational energy to the circular electric field, setting up a sustained oscillation.

At the output end of cavity 40 the inner wall of body 28 may be tapered in diameter to form an iris 42 of size selected to give the proper amount of energy coupling out of cavity 40. In very high power tubes there may be no constricted iris, the cavity being completely open-ended for maximum coupling. In either case, an outwardly tapered section 44 couples the output energy into a uniform waveguide 46 which has a greater diameter than resonant cavity 40 in order to propagate a traveling wave. Beyond the output of cavity 40, the magnetic field H is reduced. Beam 34 thus expands in diameter under the influence of the expanding magnetic field lines and its own self-repulsive space charge. Beam 34 is then collected on the inner wall of waveguide 46, which also serves as a beam collector. A dielectric window 48, as of alumina ceramic, is sealed across waveguide 46 to complete the vacuum envelope.

FIG. 2 shows the cavity and output section of a modern gyro-monotron of extremely high power. In this case, stronger output coupling is needed than one gets by leaving the end of cavity 40 completely open. To increase the coupling, the output end of cavity 40' is connected to the output waveguide 46' by a slow, smooth taper. There is then no precisely defined point where one can say the cavity ends and the waveguide begins.

In a gyro-monotron of the type illustrated by FIGS. 1 and 2, interaction cavity 40 has a diameter which is large compared to a free-space wavelength, to support a $TE_{0m1}$ resonant mode and to pass a relatively large beam of electrons 34 needed for very high power generation. Cavity 40 is also several free-space wavelengths long for cumulative interaction with beam 34 which has an axial drift velocity as well as the transverse orbital motion which interacts with the circular electric field of the cavity mode. Cavity 40 can thus support standing and traveling waves in other lower-order modes. These other modes interact with beam 34 either very weakly or in a deleterious fashion, breaking up the synchronous bunching of beam 34.

The unwanted modes are excited by any departure from perfect axial symmetry of cavity 40. Particularly troublesome are modes which are degenerate with the $TE_{0m1}$ operating mode. That is, modes having the same resonant frequency as the operating mode. When two modes are degenerate and have high Q, coupling between them by even a minute asymmetry can result in a large transfer of mode energy.

To illustrate this problem, field patterns of three modes of interest are shown by FIGS. 3, 4 and 5. These are for a cavity of right circular cylindrical shape, closed at both ends. In practical cavities having large coupling apertures, the mode patterns become less symmetrical, but the basic field shapes remain. The electric field lines 60 are shown solid and the magnetic field lines 62 dotted. A small circle with a point inside, 64, represents a field line coming out of the paper and a circle with a cross, 66, represents a line entering the paper. The first mode number is the number of cyclic variations in electric field encountered going around the cylinder azimuthally, the second number is the number of maxima on a radius from the axis, the third number is the number of maxima along the cavity length. FIG. 3 shows the $TE_{011}$ mode. The $TE_{0m1}$ cavity modes are the ones used in gyro-klystrons. Their electric field lines are coaxial circles. For simplicity, the lowest order of these, the $TE_{011}$ is illustrated here.

FIG. 4 shows the $TM_{111}$ mode. The $TM_{1m1}$ modes are troublesome because in a closed right circular cylindrical cavity they are degenerate with the useful $TE_{0m1}$ modes.

FIG. 5 shows the $TM_{110}$ mode. The family of $TM_{1m0}$ are also troublesome because the transverse field patterns are identical to the $TM_{1m1}$ modes. Thus, when the cavity is very long compared to its diameter, the absence of a single longitudinal variation of field does not change the resonant frequency much. The resonance is very close to the $TM_{1m1}$ and hence, the $TE_{0m1}$.

In the prior art, non-circular modes have been damped by adding circular grooves in cavity walls and filling them with lossy material. The grooves are perpendicular to the cavity axis so wall currents of the $TE_{0m1}$ mode do not cross them and the electric field falls quickly to zero with depth into the groove. Thus, there is not much energy loss for the circular electric field mode. Other modes, however, generally have axial components of wall current which cross the groove, exciting electric field in it which is absorbed by the lossy material, thereby damping the unwanted modes. The problem with this scheme is that with the very high power levels generated by the gyro-klystron, the lossy material burns up.

Applicants have discovered that unwanted modes may also be damped by coupling their fields thru the output aperture 42 into the output waveguide 46 and thence into space or the useful microwave load. However, even when aperture 42 is as big as cavity 40, i.e., no restriction in diameter, the coupling out may be so weak that harmful spurious mode fields may still exist in cavity 40. Modes of the $TM_{1m0}$ type (FIG. 5) have proven very bad in the gyro-klystron. These modes having no axial field variation are resonant at the cut-off frequency of the waveguide. They are pure standing waves having zero group velocity, as distinct from modes having axial field variations whose standing waves are equivalent to a traveling wave being reflected at the cavity ends. Applicants have found that even when the gyrotron cavity has a completely open end for output coupling, the $TM_{1m0}$ modes still have a high Q resonance. The coupling out of energy seems to be more of a leakage phenomenon than a traveling wave transport of energy.

We have discovered that a circular groove 50 (FIG. 1). in the wall of cavity 40, containing no lossy material, lowers the frequency of the degenerate or nearly degenerate $TM_{nm}$ modes so they are less strongly excited by the operating $TE_{0m1}$ mode. Also, the Q of the $TM_{1m0}$ modes is also greatly reduced so that their interaction impedance with the beam is lowered. This surprising result is not fully understood. It seems possible that the groove 50 may provide an intercoupling between the $TM_{1m0}$ and the $TM_{1m1}$, whereby energy from the $TM_{1m0}$ which is normally very weakly coupled into the output waveguide is transformed into $TM_{1m1}$ which, being a reflected traveling wave, is much more strongly coupled.

The above examples are intended to be illustrative and not limiting. It will become apparent to those skilled in the art that groove 50 may have a variety of cross-sectional shapes. Almost any abrupt departure from a smooth cylindricl cavity wall should produce the effect desired. The invention is to be limited only by the following claims and their legal equivalents.

We claim:

1. In a gyrotron:

means for forming a beam of spiraling charged particles, a hollow conducting cavity shaped to resonate in a mode with circular electric field, an end of said cavity comprising an opening for passage of said beam, an end of said cavity comprising an opening connecting to a circular waveguide capable of transmitting a wave having a circular electric field, the improvement being a groove in the wall of said cavity, said groove running parallel to said electric field of said mode, the walls of said groove having low resistive loss and the interior of said groove having low dielectric loss, whereby field patterns of modes with non-circular electric fields are perturbed with only a small dissipation of their energy.

2. The gyrotron of claim 1 wherein said cavity, said waveguide, said groove and said openings are figures of revolution about an axis.

3. The gyrotron of claim 2 wherein the outline of said beam is a figure of revolution about said axis.

4. The gyrotron of claim 1 wherein said wall of said cavity is of high-conductivity metal and the walls, including the bottom, of said groove are of high-conductivity metal and the interior of said groove is empty.

* * * * *